United States Patent [19]

Haley

[11] 4,201,576

[45] May 6, 1980

[54] METHOD FOR REFINING FERROPHOSPHORUS FOR USE IN THE PRODUCTION OF PHOSPHORUS-CONTAINING STEEL

[76] Inventor: George D. Haley, 12 Imperial Dr., Greenville, Pa. 16125

[21] Appl. No.: 934,665

[22] Filed: Aug. 17, 1978

[51] Int. Cl.[2] ..... C22C 33/00; C22C 39/54

[52] U.S. Cl. ..... 75/132

[58] Field of Search ..... 75/132

[56] References Cited

U.S. PATENT DOCUMENTS

| | | | |
|---|---|---|---|
| 302,158 | 7/1884 | Reese | 75/132 |
| 1,655,981 | 1/1928 | Barr | 75/132 |
| 1,751,783 | 3/1930 | White | 75/132 |
| 1,882,517 | 10/1932 | Neumark | 75/132 |
| 2,208,974 | 7/1940 | Haglund | 75/132 |
| 2,390,346 | 12/1945 | Bayer | 75/46 |
| 2,767,077 | 10/1956 | Perrin | 75/52 |
| 2,793,110 | 5/1957 | Kosmider | 75/60 |
| 3,323,864 | 6/1967 | Lapple | 75/165 |
| 3,343,909 | 9/1967 | Kim | 23/22 |
| 3,382,063 | 5/1968 | Imperato | 75/3 |
| 3,677,741 | 7/1972 | Stenzel | 75/132 |
| 3,744,999 | 7/1973 | Scott | 75/132 |

*Primary Examiner*—P. D. Rosenberg

*Attorney, Agent, or Firm*—Thomas H. Murray

[57] ABSTRACT

A low elemental silicon source of ferrophosphorus used to increase the phosphorus content of molten iron, steel and their alloys is prepared by pulverizing ferrophosphorus having an elemental silicon content in excess of 1 percent by weight to enable it to pass a ⅜-inch sieve. Next, phosphoric acid is mixed with the ferrophosphorus. The phosphoric acid oxides substantially all of the elemental silicon to silica. After oxidation, the resulting composition is dried and formed into the desired size and shape for ease of handling during iron and steel making processes.

6 Claims, No Drawings

METHOD FOR REFINING FERROPHOSPHORUS FOR USE IN THE PRODUCTION OF PHOSPHORUS-CONTAINING STEEL

BACKGROUND OF THE INVENTION

1. Field of the Invention

This invention relates to a process or method for refining ferrophosphorus for use in the production of phosphorus containing iron, steel and alloys thereof.

Ferrophosphorus is usually obtained as a by-product from well known thermal processes for the production of elemental phosphorus. The ferrophosphorus by-product usually contains 20 to 30% phosphorus, 50 to 75% iron, and may contain varying small amounts of vanadium, chromium, titanium, manganese and nickel, depending upon the composition of the phosphate rock used in the process. Additionally, ferrophosphorus may contain elemental silicon in values in excess of 1 percent.

Through the use of ferrophosphorus in iron and steel making processes, desirable amounts of phosphorus can be incorporated in the resulting alloys. In many of these alloys, however, the presence of elemental silicon in excess of 1 percent in the alloying agent produces an adverse effect upon the properties of the alloys because of the solubility of silicon in the molten metal. It has therefore been desirable to select ferrophosphorus having a low silicon content, 1 percent being acceptable while 0.05 percent is preferred. This invention discloses a method for refining ferrophosphorus containing in excess of 1 percent elemental silicon to enable its use as a phosphorizing substance in the iron and steel making process where the elimination of the deleterious effects of silicon is required.

2. Description of the Prior Art

Processing ferrophosphorus to reduce the elemental silicon content to levels acceptable for use in iron and steel making is not new in the art. A method used to indirectly reduce the elemental silicon content has been the selection of raw materials used to produce elemental phosphorus. By proper selection of the raw materials, elemental silicon levels in the ferrophosphorus by-product can be controlled. This method generally increases costs because of the selectivity required for the raw materials. Alternatively, ferrophosphorus can be subjected to processes to remove the undesirable elemental silicon or to convert it to silica which is insoluble in the molten iron and steel.

In U.S. Pat. No. 3,744,999, there is disclosed a composite composition comprising high silicon content ferrophosphorus admixed with a solid oxidizing agent and integrally composited. This composite composition is then added to the molten iron or steel causing the silicon to be oxidized to silica. It is essential that the composition possess certain "critical characteristics" including: (1) an oxidizing agent which is solid at ambient temperature and a thermally stable liquid at the temperature of molten iron; and (2) thorough mixing and compositing so that upon addition to a molten metal bath, the oxidizing agent will remain in integral contact with the ferrophosphorus for a length of time sufficient to effect oxidation of the silicon contained therein. The invention of this disclosure is distinguishable in that it requires neither of these "critical characteristics" as will be explained hereafter.

SUMMARY OF THE INVENTION

This invention relates to a method or process for producing a low elemental silicon ferrophosphorus product for use in producing phosphorus containing steels. Specifically, this method comprises pulverizing ferrophosphorus having an elemental silicon content in excess of 1 percent by weight to enable the ferrophosphorus to pass a ⅜-inch sieve; mixing a liquid oxidizing agent, such as phosphoric acid, with the pulverized ferrophosphorus; oxidating substantially all of the elemental silicon to silica; and drying the resulting product. The product of this method can then be added to molten iron, steel or their alloys to phosphorize the molten metal without the adverse effects of elemental silicon. The use of phosphoric acid in the process of this invention produces an added benefit, that of increasing the phosphorus content of the resulting composition.

DESCRIPTION OF THE PREFERRED EMBODIMENT

Low elemental silicon ferrophosphorus used to phosphorize iron, steel and their alloys in the steel making process is prepared by the method of this invention from ferrophosphorus containing in excess of 1 percent elemental silicon. The ferrophosphorus containing silicon in excess of 1 percent is obtained from fines generated from other processes or is crushed, pulverized or in some manner known to those in the art, reduced to particle sizes capable of passing a ⅜-inch sieve. Phosphoric acid, a liquid oxidizing agent, is then mixed with the pulverized ferrophosphorus. The elemental silicon contained in the pulverized ferrophosphorus is oxidized to silica, a compound which is insoluble in molten iron and steel, by the chemical oxidation action of the phosphoric acid. Heat and hydrogen gas are produced during the oxidation process. The general reaction is:

liquid oxidizing agent + ferrophosphorus → complex ferrophosphide + silica + gas + heat.

The resulting composition, which comprises the complex ferrophosphide and silica, is dried by heating at a temperature in excess of 900° F. and can then be added to molten iron, steel or their alloys to phosphorize the resulting alloy. For ease of handling and storage, the resulting composition can be formed into the desired size and shape, such as briquettes, or can be formed into a desired shape then broken into the size desired or required for ease of handling and added to the molten iron, steel or their alloys. For a more dense product pressure can be applied during the forming process. Crushing or breaking the agglomerate can be accomplished by methods known to those skilled in the crushing art.

Although the invention has been shown in connection with certain specific embodiments, it will be readily apparent to those skilled in the art that various changes in form and method steps can be made to suit requirements without departing from the spirit and scope of the invention.

I claim:

1. A method for producing phosphorus-containing steels from high silicon ferrophosphorus which comprises pulverizing ferrophosphorus having an elemental silicon content in excess of 1 percent by weight to enable said pulverized ferrophosphorus to pass a ⅜ inch sieve, mixing a liquid oxidizing agent with said pulverized ferrophosphorus whereby substantially all of said elemental silicon will be oxidized to silica, drying the resulting product, and adding said resulting product with the silicon oxidized to silica to molten steel to phosphorize the same.

2. The method of claim 1 in which the drying step further comprises forming the resulting product into a desired size and shape.

3. The method of claim 1 wherein the drying step further includes forming the resulting product into the desired shape and then breaking said shape into pieces of desired size.

4. The method of claim 2 or 3 in which the forming step further comprises applying pressure to form a more dense product.

5. The method of claim 1 wherein the liquid oxidizing agent is phosphoric acid.

6. The method of claim 1 wherein said liquid oxidizing agent is mixed with the pulverized ferrophosphorus at ambient temperature and wherein the elemental silicon is oxidized to silica without the addition of heat.

* * * * *